US007806188B2

(12) United States Patent
Hearn

(10) Patent No.: US 7,806,188 B2
(45) Date of Patent: Oct. 5, 2010

(54) METHODS AND APPARATUS FOR OPTIMIZING WELL PRODUCTION

(75) Inventor: William Hearn, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/369,142

(22) Filed: Feb. 11, 2009

(65) Prior Publication Data

US 2009/0200020 A1 Aug. 13, 2009

Related U.S. Application Data

(62) Division of application No. 11/180,200, filed on Jul. 13, 2005, now Pat. No. 7,490,675.

(51) Int. Cl.
*E21B 43/25* (2006.01)

(52) U.S. Cl. ..... 166/372; 166/250.15

(58) Field of Classification Search ..... 166/250.15, 166/372, 263, 53
See application file for complete search history.

(56) References Cited

U.S. PATENT DOCUMENTS

| | | | | |
|---|---|---|---|---|
| 3,266,574 | A | 8/1966 | Gandy | |
| 3,396,793 | A | 8/1968 | Piper et al. | |
| 3,422,891 | A * | 1/1969 | Dew | 166/256 |
| 3,678,997 | A | 7/1972 | Barchard | |
| 3,863,714 | A | 2/1975 | Watson, Jr. | |
| 4,461,172 | A | 7/1984 | McKee et al. | |
| 4,685,522 | A * | 8/1987 | Dixon et al. | 166/372 |
| 4,921,048 | A | 5/1990 | Crow et al. | |
| 4,989,671 | A | 2/1991 | Lamp | |
| 5,132,904 | A | 7/1992 | Lamp | |
| 5,146,991 | A | 9/1992 | Rogers, Jr. | |
| RE34,111 | E | 10/1992 | Wynn | |
| 5,314,016 | A | 5/1994 | Dunham | |
| 5,488,993 | A | 2/1996 | Hershberger | |
| 5,517,593 | A | 5/1996 | Nenniger et al. | |
| 5,622,223 | A | 4/1997 | Vasquez | |
| 5,634,522 | A | 6/1997 | Hershberger | |
| 5,636,693 | A | 6/1997 | Elmer | |
| 5,735,346 | A | 4/1998 | Brewer | |
| 5,826,659 | A | 10/1998 | Hershberger | |
| 5,873,411 | A | 2/1999 | Prentiss | |

(Continued)

FOREIGN PATENT DOCUMENTS

| | | | |
|---|---|---|---|
| EP | 0668492 | A2 | 8/1995 |

(Continued)

OTHER PUBLICATIONS

GB Combined Search and Examination Report for Application No. GB1006258.6 dated May 4, 2010.

*Primary Examiner*—Shane Bomar
(74) *Attorney, Agent, or Firm*—Patterson & Sheridan, L.L.P.

(57) ABSTRACT

Embodiments of the present invention generally relates to methods and apparatus for operating an artificial lift well. In one embodiment, the well is operated between an on cycle and an off cycle. Preferably, the off cycle is determined by detecting an increase in the pressure differential between the casing pressure and the tubing pressure. In another embodiment, the well is optimized by measuring the production of the well in one cycle of operation. The measured production is compared to the production of a previous cycle. A controller then optimizes the well based on the increase or decrease of the production from the previous cycle.

9 Claims, 3 Drawing Sheets

U.S. PATENT DOCUMENTS

| | | | | |
|---|---|---|---|---|
| 5,878,817 | A | 3/1999 | Stastka | |
| 5,941,305 | A | 8/1999 | Thrasher et al. | |
| 5,957,200 | A | 9/1999 | Majek et al. | |
| 5,984,013 | A | 11/1999 | Giacomino et al. | |
| 5,996,691 | A | 12/1999 | Norris et al. | |
| 6,196,324 | B1 | 3/2001 | Giacomino et al. | |
| 6,241,014 | B1 | 6/2001 | Majek et al. | |
| 6,293,341 | B1 | 9/2001 | Lemetayer | |
| 6,595,287 | B2 | 7/2003 | Fisher | |
| 7,464,753 | B2 * | 12/2008 | White et al. | 166/250.15 |
| 2002/0074118 | A1 | 6/2002 | Fisher | |
| 2004/0060705 | A1 | 4/2004 | Kelley | |
| 2004/0244991 | A1 | 12/2004 | Reitz | |

FOREIGN PATENT DOCUMENTS

| | | | |
|---|---|---|---|
| GB | 2188750 | A | 10/1987 |
| WO | WO-97/16624 | | 5/1997 |
| WO | WO 97/46793 | | 12/1997 |
| WO | WO 02/29197 | A2 | 4/2002 |
| WO | WO-2005/085589 | A1 | 9/2005 |

* cited by examiner

METHODS AND APPARATUS FOR OPTIMIZING WELL PRODUCTION

CROSS-REFERENCE TO RELATED APPLICATIONS

This application is a divisional of U.S. patent application Ser. No. 11/180,200, filed Jul. 13, 2005, now U.S. Pat. No. 7,490,675 which is herein incorporated by reference.

BACKGROUND OF THE INVENTION

1. Field of the Invention

Embodiments of the present invention generally relate to optimizing production of hydrocarbon wells. Particularly, embodiments of the present invention relate to an artificial lift system for moving wellbore fluids. More particularly, embodiments of the present invention relate to optimizing the production of a hydrocarbon well intermitted by a plunger lift system.

2. Description of the Related Art

The production of fluid hydrocarbons from wells involves technologies that vary depending upon the characteristics of the well. While some wells are capable of producing under naturally induced reservoir pressures, more common are wells that employ some form of an artificial lift production technique. During the life of any producing well, the natural reservoir pressure decreases as gas and liquids are removed from the formation. As the natural downhole pressure of a well decreases, the wellbore tends to fill up with liquids, such as oil and water. In a gas well, the accumulated fluids block the flow of the formation gas into the borehole and reduce the production output from the well. To combat this condition, artificial lift techniques are used to periodically remove the accumulated liquids from these wells. The artificial lift techniques may include plunger lift devices and gas lift devices.

Plunger lift production systems include the use of a small cylindrical plunger which travels through tubing extending from a location adjacent the producing formation in the borehole to surface equipment located at the open end of the borehole. In general, fluids which collect in the borehole and inhibit the flow of fluids out of the formation are collected in the tubing. Periodically, the end of the tubing located at the surface is opened via a valve, and the plunger is forced up the tubing by the accumulated reservoir pressure in the borehole. The plunger carries a load of accumulated fluids to the surface for ejection out the top of the well. After the fluids are removed, gas will flow more freely from the formation into the borehole for delivery to a gas distribution system such as a sales line at the surface. The production system is operated so that after the flow of gas from the well has again become restricted due to the further accumulation of fluid downhole, the valve is closed so that the plunger falls back down the tubing. Thereafter, the plunger is ready to lift another load of fluids to the surface upon the re-opening of the valve.

A gas lift production system is another type of artificial lift system used to increase a well's performance. The gas lift production system generally includes a valve system for controlling the injection of pressurized gas from a source external to the well, such as a compressor, into the borehole. The increased pressure from the injected gas forces accumulated formation fluid up the tubing to remove the fluids as production flow or to clear the fluids and restore the free flow of gas from the formation into the well. The gas lift system may be combined with the plunger lift system to increase efficiency and combat problems associated with liquid fall back.

The use of artificial lift systems results in the cyclical production of the well. This process, also generally termed as "intermitting," involves cycling the system between an on-cycle and an off-cycle. During the off-cycle, the well is "shut-in" and not productive. Thus, it is desirable to maintain the well in the on-cycle for as long as possible in order to fully realize the well's production capacity.

Historically, the cyclical process of artificial lift systems is controlled by pre-selected time periods. The timing technique provides for cycling the well between on and off cycles for a predetermined period of time. Deriving the time interval of these cycles has always been difficult because production parameters considered for this task are different in every well and the parameters associated with a single well change over time. For instance, as the production parameters change, a plunger lift system operating on a short timed cycle may lead to an excessive quantity of liquids within the tubing string, a condition generally referred to as a "loading up" of the well. This condition usually occurs when the system initiates the on-cycle and attempts to raise the plunger to the surface before a sufficient pressure differential has developed. Without sufficient pressure to bring it to the surface, the plunger falls back to the bottom of the wellbore without clearing the fluid thereabove. Thereafter, the cycle starts over and more fluids collect above the plunger. By the time the system initiates the on-cycle again, too much fluid has accumulated above the plunger and the pressure in the well is no longer able to raise the plunger. This condition causes the well to shut-in and represents a failure that may be quite expensive to correct.

In contrast, a lift system that operates on a relatively long timed cycle may result in waste of production capacity. The longer cycle reduces the number of trips the plunger goes to the surface. Because well production is directly related to the plunger trips, production also decreases when the plunger trips decrease. Thus, it is desirable to allow the plunger to remain at the bottom only long enough to develop a sufficient pressure differential to raise the plunger to the surface.

Improvements to the timing technique include changing the predetermined time period in response to the well's performance. For example, U.S. Pat. No. 4,921,048, incorporated herein by reference, discloses providing an electronic controller which detects the arrival of a plunger at the well head and monitors the time required for the plunger to make each particular round trip to the surface. The controller periodically changes the time during which the well is shut in to maximize production from the well. Similarly, in U.S. Pat. No. 5,146,991, incorporated herein by reference, the speed at which the plunger arrives at the well head is monitored. Based on the speed detected, changes may be made to the off-cycle time to optimize well production.

The forgoing arrangements, while representing an improvement in operating plunger lift wells, still fail to take into account some variables that change during the operation of a well. For example, sales lines pressure fluctuations affect the optimal time to commence the on cycle. A fluctuating sales line pressure will cause a change in the effective pressure available to lift liquid out of the well. Simple self-adjusting timed cycle does not take this variable into account when adjusting the length of the cycle.

There is a need, therefore, for an improved well control apparatus and method that monitor and adjust well operations to improve well production. There is also a need for a controller that optimizes the plunger lift cycle to improve the efficiency of the production from the well.

SUMMARY OF THE INVENTION

Embodiments of the present invention generally relates to methods and apparatus for operating an artificial lift well. In one embodiment, the well is operated between an on cycle and an off cycle. The off cycle may be determined by detecting an increase in the pressure differential between the casing pressure and the tubing pressure.

In another embodiment, the well is optimized by measuring the production of the well in one cycle of operation. The measured production is compared to the production of a previous cycle. A controller then optimizes the well based on the increase or decrease of the production from the previous cycle. In another embodiment still, one production cycle includes the production from the initiation of the on cycle of the first cycle up to the initiation of the next on cycle.

In another embodiment, a method of operating a well having a production tubing in selective communication with a production line comprises opening a valve between the production tubing and the production line; measuring a pressure differential between a casing pressure and a tubing pressure; and closing the valve when an increase in the pressure differential is detected. In another embodiment, the method also comprises delaying the closing of the valve.

In another embodiment, a method of operating an artificial lift system comprises determining a parameter associated with the well; comparing the parameter to a stored value; and placing a tubing in fluid communication with a delivery line in response to the comparison. The method also includes measuring a pressure differential between a casing pressure and a tubing pressure and closing fluid communication when the pressure differential increases.

In another embodiment, a method of operating an artificial lift system comprises calculating a first pressure differential between a delivery line pressure and a casing pressure; comparing the first pressure differential to a stored value; and placing a tubing in fluid communication with a delivery line when the first pressure differential is at least the same as the first stored value. The method also comprises measuring a second pressure differential between the casing pressure and a tubing pressure and closing fluid communication when the second pressure differential increases. In another embodiment, the method further comprises delaying closing fluid communication for a period of time.

In another embodiment, a method of optimizing an artificial lift cycle of a well comprises measuring a first production of the well in a first cycle of operation; measuring a second production of the well in a second cycle of operation; comparing the first production to the second production; and adjusting one or more well operating parameters in response to the comparison. In another embodiment, the method further comprises relating each of the first production and the second production to a daily production of the well.

In another embodiment, an automated method and apparatus for operating an artificial lift well is provided. An on-cycle of the well is initiated based on a pressure differential measured between a casing pressure and a sales line pressure. When a predetermined ON pressure differential is observed, a controller initiates the on-cycle and opens a motor valve to permit fluid and gas accumulated in the tubing to flow out of the well. Thereafter, a mandatory flow period is initiated to maintain the motor valve open for a period of time. The valve remains open as the system transitions into the sales time period. During sales time, the controller monitors the pressure differential between the casing pressure and the tubing pressure. When an increase in pressure differential is detected, the controller initiates the off cycle. The off cycle starts with a mandatory shut-in period to allow the plunger to fall back into the well. Thereafter, the well remains in the off-cycle until the controller receives a signal that the ON pressure differential has developed.

In another embodiment, the controller may automatically adjust the operating parameters. After a successful cycle, the controller may decrease the predetermined ON pressure differential, increase the mandatory flow period, and/or decrease the predetermined OFF pressure differential to optimize the well's production. Additionally, adjustments may be performed if the well is shut-in before a cycle is completed.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
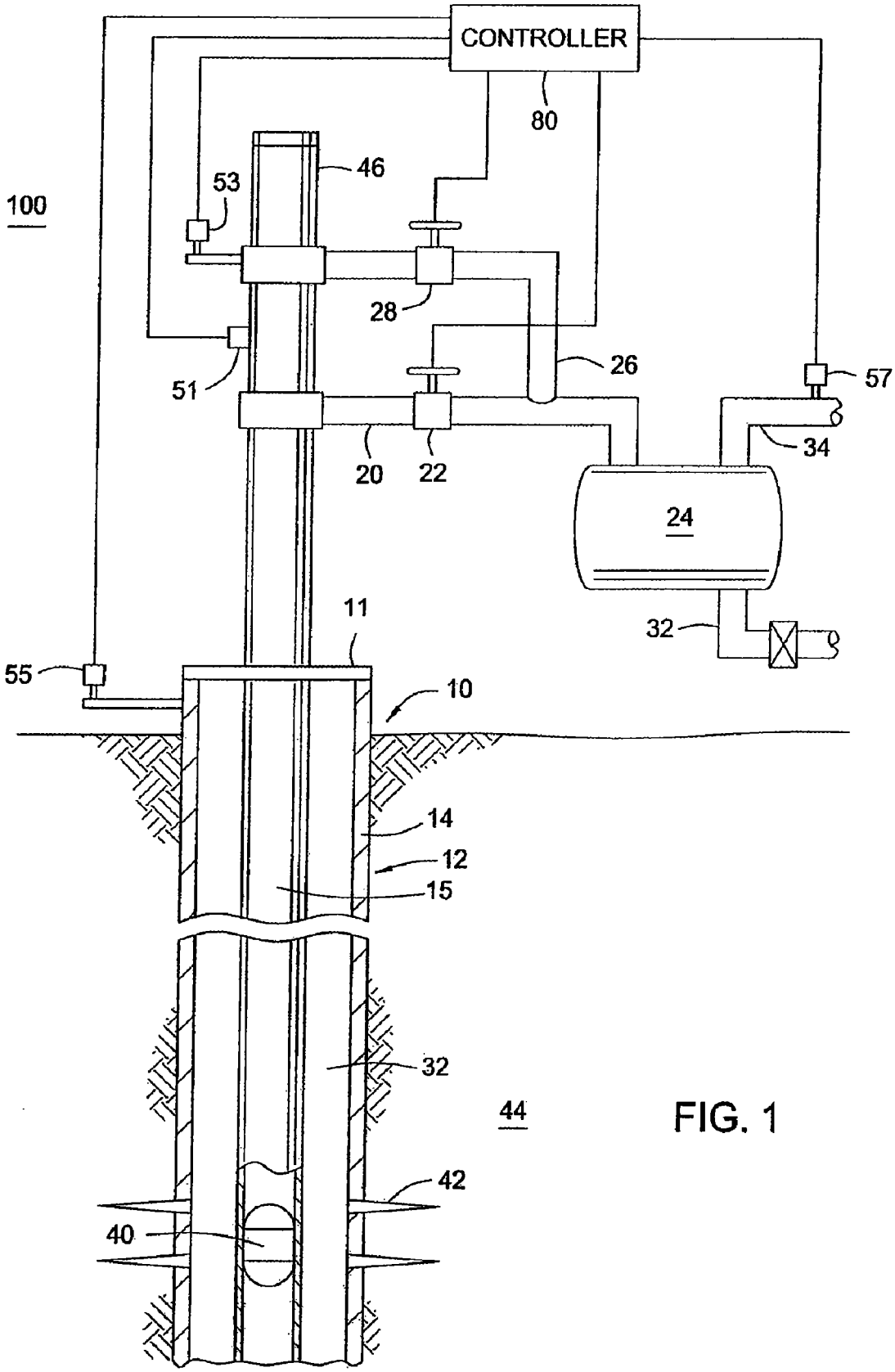
FIG. 1 is a schematic drawing of a plunger lift system.

FIG. 1 is a schematic view of an embodiment of the present invention applied to a plunger lift system 100. The well 10 includes a wellbore 12 which is lined with casing 14 and a string of production tubing 15 disposed therein. Perforations 42 are formed in the casing 14 for fluid communication with an adjacent formation 44. The production tubing 15 and casing 14 extend from a well head 11 located at the surface to the bottom of the well 10. A plunger 40 is disposed at the bottom of the tubing 15 when the system 100 is shut-in. A lubricator 46 for receiving the plunger 40 is disposed at the top of the tubing 15. The lubricator 46 includes a plunger arrival sensor 51 for detecting the presence of a plunger 40 and a tubing pressure sensor 53 to monitor the pressure in the tubing 15. The casing pressure, which is the pressure in an annular area 32 defined by the exterior of the tubing 15 and the interior of the casing 14, is monitored by a casing pressure sensor 55 disposed adjacent the well head 11.

A first delivery line 26 having a motor valve 28 connects an upper end of the tubing 15 to a separator 24. The separator 24 separates liquid and gas from the tubing string 15. Liquid exits the separator 24 through a line 32 leading to a tank (not shown), and gas exits the separator 24 through a sales line 34. The pressure in the sales line 34 is monitored by a sales line pressure sensor 57. A second delivery line 20 having a well head valve 22 connects the upper end of the tubing 15 to the first delivery line 26 at a position between the motor valve 28 and the separator 24.

A controller 80 is provided to monitor the conditions of the well 12 and to optimize the operation of the plunger lift system 100 based on the monitored conditions. In one embodiment, the controller 80 is adapted to receive information from the tubing pressure sensor 53, the casing pressure sensor 55, and the sales line pressure sensor 57. Information from the plunger arrival sensor 51 is also transmitted to the controller 80. The controller 80 is adapted to control the motor valve 28 and the well head valve 22 in response to information received from the sensors 51, 53, 55, 57. In one embodiment, the controller 80 is programmed to process inputs from the sensors 51, 53, 55, 57 in accordance with a motor control sequence for optimizing the well. Outputs generated from the controller 80 are used to control the operation of the plunger lift system 100.

Figure 2:
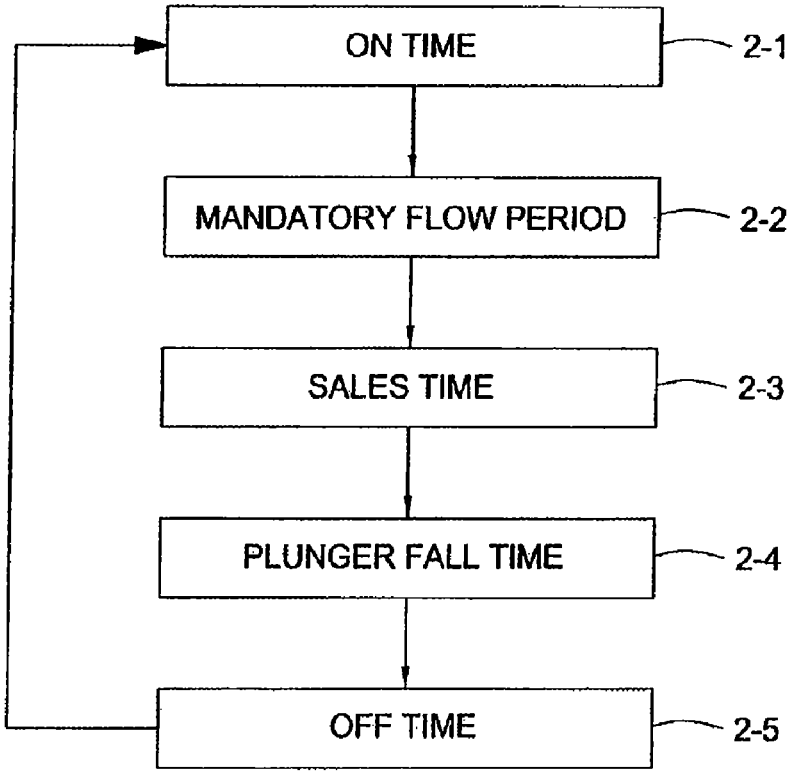
FIG. 2 is illustrates an exemplary cycle of operation.

FIG. 2 shows an exemplary cycle of operation of the plunger lift system 100. Starting with the off-cycle, the plunger 40 is disposed at the bottom of the well 10 and the motor valve 28 is closed. During this time, also known as the "off-time" 2-5, the casing pressure increases as a result of an inflow of gases and fluids from the formation 44 to the wellbore 12 through perforations 42 in the casing 14. The controller 80 is programmed to maintain the well in off-time 2-5 until an "ON" condition is detected. In one embodiment, the ON condition is a pre-selected "ON" pressure differential between the casing pressure and the sales line pressure. Preferably, the pre-selected ON pressure differential is sufficient to raise the plunger 40 along with the accumulated fluids to the surface. Using signals from the casing pressure sensor 55 and the sales pressure sensor 57, the controller 80 calculates the pressure differential between the casing pressure and the sales pressure. When the pressure differential is at least equal to the pre-selected ON pressure differential, the controller 80 initiates the on-cycle, or "on time" 2-1. Other exemplary ON conditions to initiate the on-cycle may include a value based on a Foss and Gaul calculation; a value based on a load factor calculation; any combination of tubing pressure, casing pressure, sales line pressure, and pressure differential therebetween; any ON conditions known to a person of ordinary skill; and any combinations thereof.

In the on time mode 2-1, the controller 80 opens the motor valve 28 to expose and reduce the tubing pressure to the sales line pressure. Reducing the tubing pressure unlocks the pressure differential between the sales line pressure and the casing pressure. This pressure differential urges the plunger 40 upward in the tubing 15, thereby transporting a column of fluid thereabove to the well head 11.

Following the on time period 2-1, the controller 80 looks for a trigger to initiate a mandatory flow period 2-2. In one embodiment, the trigger sought by the controller 80 may be a signal from the plunger arrival sensor 51 to indicate that the plunger 40 has successfully arrived at the surface within a prescribed first time period. If the plunger 40 is detected during the first time period, the controller 80 will initiate the mandatory flow period 2-2. If the plunger 40 is not detected within the first time period, the controller 80 will continue to look for the trigger within a second time period. In another embodiment, the trigger to initiate the mandatory flow period 2-2 may be a signal indicating a drop in the casing pressure to verify that the plunger 40 has been lifted.

During the second time period, the controller 80 may make adjustments to the wellbore 12 conditions to facilitate the plunger's 40 upward progress in the tubing 15. For example, the controller 80 may be programmed to open a vent valve (not shown) to reduce the tubing pressure in order to decrease the resistance against the plunger's 40 upward movement. Because the movement of the plunger 40 is related to the pressure differential, it may be possible that the plunger 40 failed to reach the surface within the first time period because the wellhead pressure is too high. Therefore, when the controller 80 does not receive an indication that the plunger 40 successfully reached the surface within the first time period, the controller 80 will open the vent valve to facilitate the plunger's 40 ascent. If the plunger 40 is detected during this second time period, the controller 80 will initiate the mandatory flow period 2-2 and close the vent valve. However, if the plunger 40 fails to reach the surface during this second time period, the controller 80 will shut-in the well 10 and re-enter the off time mode 2-5.

The mandatory flow period 2-2 provides a period of time for the well 10 to stabilize and ensures that fluid has been ejected and that the well 10 is again performing as an unloaded well 10. During the mandatory flow period 2-2, the controller 80 is programmed to ignore information from the sensors that would normally cause the controller 80 to shut-in the well 10. At the expiration of the mandatory flow period 2-2, the controller 80 initiates a sales time period 2-3.

Sales time period 2-3 is the phase in the cycle when production gas is allowed to flow from the well 10 to the sales line 34. During this time, the casing pressure and the tubing pressure is monitored to determine the end of the on-cycle.

The controller 80 will end the on cycle when the pressure differential between the casing pressure and the tubing pressure meets a certain condition, i.e., OFF condition. In one embodiment, the on cycle will end when the pressure differential begins to increase, which may be referred to herein as the "OFF" pressure differential. In this respect, the controller 80 is programmed to monitor the pressure differential during sales time 2-3 and end the on-cycle when the pressure differential begins to increase. In another embodiment, the controller 80 may be programmed to monitor the pressure differential after initiation of the mandatory flow period 2-2, e.g., after the plunger has arrived in the case of the plunger lift system or after the well has begun unloading in the case of intermitting. However, the controller 80 is not allowed to end the on-cycle during the mandatory flow period 2-2.

Figure 3:
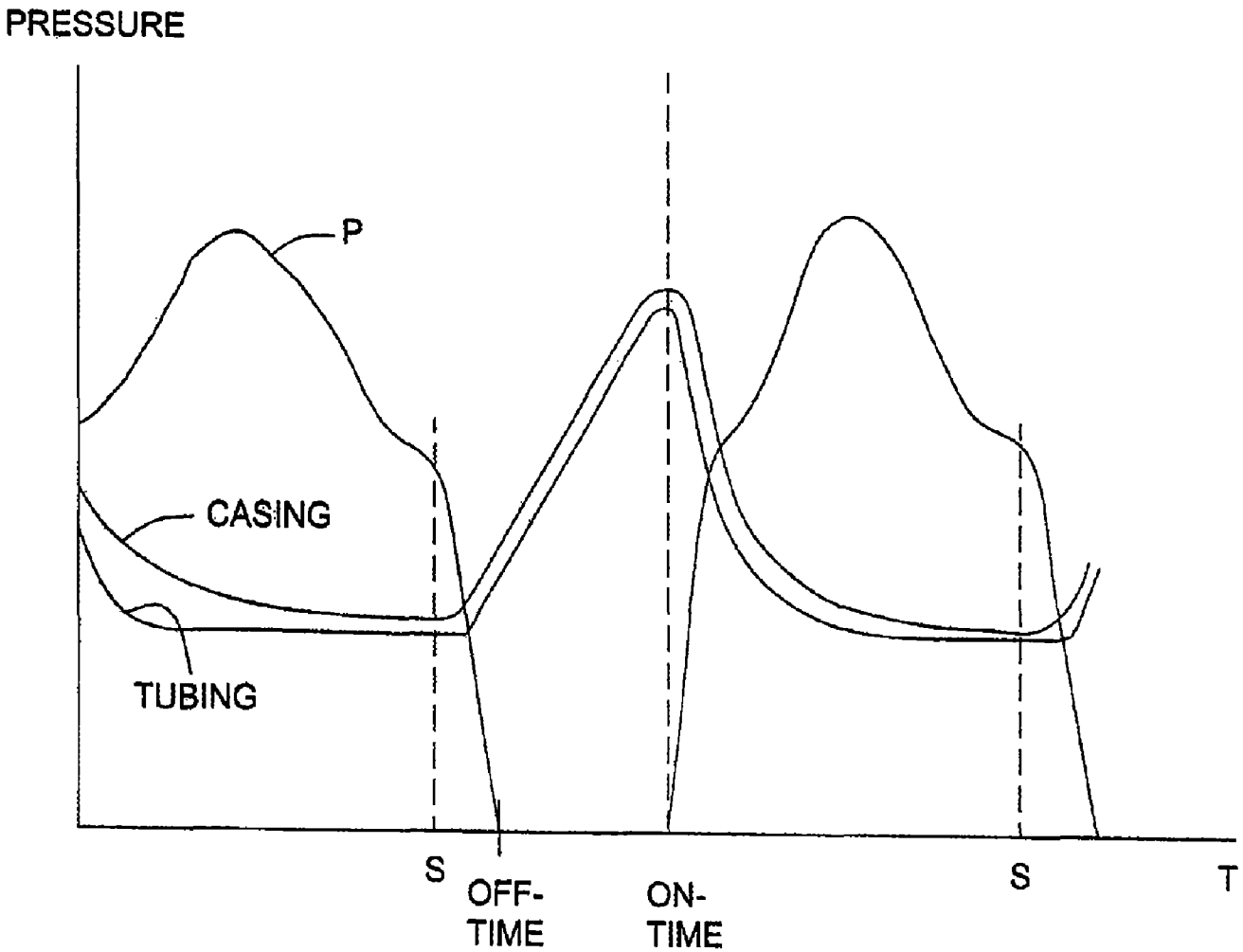
FIG. 3 is graph of well operation parameters.

Referring now to FIG. 3, at the start of the on-cycle, both the tubing pressure and the casing pressure experience a significant decrease due to the lower pressure in the sales line. As sales time progresses, the rate of decrease of the pressures becomes more gradual. In the case of the tubing pressure, the rate of decrease may level out to a point where there is little or no change. Thus, the pressure differential between the casing pressure and the tubing pressure will decrease or remain the same during sales time. As the well begins to load up with liquid, the pressure differential between the casing and tubing will start to increase. The time at which the pressure differential between the casing pressure and the tubing pressure begins to increase is known as the sway point S. It has been found that the production rate P significantly decreases after the sway point S, as shown in FIG. 3. Therefore, detection of an increase in the pressure differential provides an optimal indicator for the controller 80 to close the motor valve 28 and shut-in the well 10, thereby ending the on-cycle. Moreover, because pressure differential is less affected by pressure fluctuations in the well in comparison to measuring casing pressure alone, the pressure differential provides a more accurate indicator for the occurrence of the sway point S. In this manner, operation of the well 10 is optimally controlled by the production rate of the well itself.

In the preferred embodiment, the controller 80 will delay the closing of the motor valve 28 for a period of time after an increase in the pressure differential is detected. In some instances, unexpected pressure fluctuations will cause an increase in the pressure differential. The delay allows the controller 80 to account for this anomaly or other false readings, thereby preventing the premature shut-in of the well. In one embodiment, the extent of the delay may be a predetermined time period after the initial pressure differential is detected. In another embodiment, the extent of the delay is determined by pressure differentials measured at two different times. Because the pressure differential should continue to increase after the sway point S, a larger, later measured pressure differential will confirm that the sway point S has occurred. In this manner, the controller 80 may avoid prematurely shutting in the well 10.

After the well 10 is shut-in, the controller 80 initiates a mandatory shut-in period, also known as the plunger fall time 2-4. The mandatory shut-in period 2-4 provides a period of time for the plunger 40 to fall back down the tubing 15 and collect more fluid before the on-cycle is initiated. During the mandatory shut-in period 2-4, the controller 80 is programmed to not recognize an ON condition reading, such as an ON pressure differential, and maintain the well 10 in the shut-in mode as the plunger 40 falls back. As shown in FIG. 3, the casing pressure and the tubing pressure rise after shut-in and will build toward the ON pressure differential. Once the mandatory shut-in period 2-4 expires, the well enters the "Off-Time" phase 2-5 where the controller 80 will look for the ON pressure differential and start a subsequent cycle.

If the system 100 successfully completes a cycle, the controller 80 may automatically adjust the parameters of the system 100 to optimize the production. Generally, the controller 80 will adjust the parameters so that the plunger 40 will stay at the bottom for a shorter period of time and the sales line 34 will remain open for a longer period of time. In one embodiment, the controller 80 may decrease the predetermined ON pressure differential for the subsequent cycle by about 10%. As a result, less time is required for the well 10 to develop the reduced ON pressure differential and initiate the on-time mode 2-1. It is also contemplated that the controller 80 may be programmed to adjust any selected ON condition to optimize the well as is known to a person of ordinary skill in the art. In another embodiment still, the controller 80 may increase the delay of closing the valve to allow the pressure differential to sway further apart after the sway point is detected. In this respect, the sales line 34 will stay open for a longer period of time, thereby increasing production.

Adjustments may also be made if the well 10 does not successfully complete the cycle before shutting-in. As described above, the controller 80 will shut-in the well 10 if the mandatory flow period 2-2 is not initiated before the expiration of the prescribed time periods for detecting the plunger 40 arrival. If this occurs, the controller 80 will automatically adjust the parameters of the cycle to ensure that the plunger 40 will reach the surface during the subsequent cycle. In one embodiment, the controller 80 will increase the predetermined ON pressure differential by about 10% in order to provide more force to raise the plunger 40 up the tubing 15. In general, the adjustments made will increase the probability that the plunger 40 will reach the surface in the subsequent cycle.

In another embodiment, the on cycle and the off cycle may be initiated by a single measured point or from the differential between two measured points that are relevant in optimizing well performance. In the plunger case described above, the on-cycle is initiated based on a pressure differential between the casing pressure and the sales line pressure. However, the controller may be programmed to initiate the on-cycle based on a pressure differential between the casing pressure and the tubing pressure or a pressure differential between the tubing pressure and the sales line pressure. Also, the controller may be programmed to initiate the on-cycle when the casing pressure reaches a specified pressure value.

Embodiments of the present invention are advantageous in that the production cycle is controlled by the parameters that affect the production of the well 10. Specifically, the well 10 enters the on time mode only when the well has met the predetermined or optimized ON conditions. In this respect, the plunger 40 is accorded a higher probability that it will reach the lubricator 46 and deliver the fluid and gases. Thereafter, the well 10 continues to produce sales flow until the pressure differential between the casing pressure and the tubing pressure increases, which indicates that the production rate has decreased. In this respect, the sales time period 2-3 is not cut short by a predetermined time period.

An exemplary cycle of well operation may be summarized as shown in FIG. 3. Using the plunger lift system described above, the system is in the off time mode, shown as step 2-5. When the ON pressure differential is reached, the controller 80 initiates the ON time mode as shown in step 2-1. During the on time mode 2-1, the controller 80 looks for a trigger such as sensing the plunger 40 at the surface. When the trigger is detected, the controller 80 initiates the mandatory flow period, shown as step 2-2, to allow for removal of fluid from the tubing 15. At the expiration of the mandatory flow period 2-2, the controller 80 initiates the sales time for production gas flow, shown as step 2-3. The sales time 2-3 ends when the OFF pressure differential is met, i.e., the pressure differential between the casing pressure and tubing pressure increases. At the beginning of the off-cycle, the controller 80 initiates the plunger fall time to give the plunger 40 sufficient time to fall back down the wellbore as show in step 2-4. At the end of plunger fall time 2-4, the system enters the off time mode as shown in step 2-5. During off time mode 2-5, the controller 80 makes adjustments to the operating parameters to optimize the well 10. If the ON pressure differential is adjusted, the cycle will start over when the new ON pressure differential is met.

In another embodiment, the well may be optimized based on the amount of production in a given cycle. A production cycle begins from the initiation of the on cycle and ends right before the initiation of the on cycle of the next cycle. Initially, the production of a completed cycle is related a daily production rate. Thereafter, the daily production rate of the completed cycle is compared to the daily production rate of the previous cycle. The controller will optimize the well operating conditions depending on whether the production increased or decreased from the previous cycle. For example, positive production results will cause the controller to continue well optimization, and negative production results will cause the controller to reinstate the well operating conditions before the last optimization. The controller may continue to reinstate prior well operating conditions until a positive production result occurs. In this respect, well optimization is based on production and has no relationship to plunger arrival times, completion of cycle, or ON or OFF conditions. However, it must be noted that optimization based on production rate may be used alone or in combination with any other optimization methods disclosed herein.

The Controller

The controller 80 may be configured to execute various optimization techniques in accordance with a computer program for performing the motor control sequence. The computer program may run on a conventional computer system comprising a central processing unit ("CPU") interconnected to a memory system with peripheral control components. The program for executing the well optimization methods may be stored on a computer readable medium, and later retrieved and executed by a processing device. The computer program code may be written in any conventional computer readable programming language such as C, C++, or Pascal. If the entered code text is in a high level language, the code is compiled, and the resultant compiler code is then linked with an object code of precompiled windows library routines. To execute the linked compiled object code, the system user invokes the object code, causing the computer system to load the code in memory, from which the CPU reads and executes the code to perform the tasks identified in the program.

Figure 4:
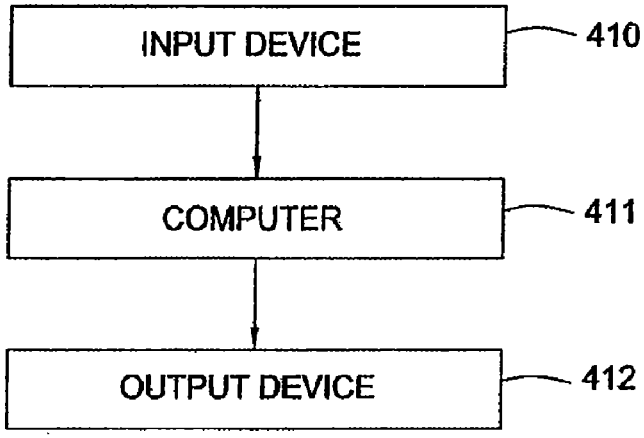
FIG. 4 is illustrates an exemplary hardware configuration.

An exemplary hardware configuration for implementing optimization methods disclosed herein is illustrated in FIG. 4. An input device 410 may be used to receive and/or accept input from the sensors representing basic physical characteristics of the artificial lift system and the well. These basic characteristics may include casing pressure, tubing pressure, sales line pressure, and plunger arrival indicator. This information is transmitted to a processing device, which is shown as a computer 411. The computer 411 processes the input information according to the programmed code to determine the operational parameters of the artificial lift system. Upon completing the data processing, the computer 411 outputs the resulting information to the output device 412. The output device may be configured to operate as a controller 80 for the artificial lift system, which could then alter an operational parameter of the artificial lift system in response to analysis of the system. For example, if analysis of the artificial lift system determines that a full cycle was completed successfully, then the controller 80 may be configured to adjust an operational parameter for a subsequent cycle in order to optimize well production. In another example, the output device may operate to display the processing results to the user. Common output devices used with computers that may be suitable for use include monitors, digital displays, and printing devices.

While the foregoing is directed to embodiments of the present invention, other and further embodiments of the invention may be devised without departing from the basic scope thereof, and the scope thereof is determined by the claims that follow.

I claim:

1. A method of optimizing an artificial lift cycle of a well having a casing and a production tubing in selective communication with a production line, the method comprising:

measuring a first production of the well in a first cycle of operation;

measuring a second production of the well in a second cycle of operation, wherein at least one of the cycles of operation comprises:

opening a valve between the production tubing and the production line;

determining a pressure differential between the pressure in the casing and the pressure in the production tubing; and closing the valve when an increase in the pressure differential is detected;

comparing the first production to the second production; and adjusting one or more well operating parameters in response to the comparison.

2. The method of claim 1, further comprising relating each of the first production and the second production to a daily production of the well.

3. The method of claim 1, wherein prior values of one or more well operating parameters are reinstated when the first production is less than the second production.

4. The method of claim 3, wherein the prior values of one or more well operating parameters are reinstated until the first production is greater than the second production.

5. A method of optimizing an artificial lift cycle of a well having a casing and a production tubing, the method comprising:

measuring a first production of the well in a first cycle of operation;

measuring a second production of the well in a second cycle of operation, wherein at least one of the cycles of operation comprises:

opening fluid communication between the production tubing and a production line;

determining a pressure differential between the pressure in the casing and the pressure in the production tubing; and closing fluid communication when an increase in the pressure differential is detected;

comparing the first production to the second production; and determining a parameter associated with the well in response to the comparison.

6. The method of claim 5, further comprising comparing the parameter to a stored value.

7. The method of claim 5, further comprising relating each of the first production and the second production to a daily production of the well.

8. The method of claim 5, further comprising adjusting the parameter associated with the well.

9. The method of claim 8, wherein adjusting the parameter includes reinstating prior values of the parameter when the first production is less than the second production.

* * * * *